US005139232A

United States Patent [19]

Bailey

[11] Patent Number: 5,139,232

[45] Date of Patent: Aug. 18, 1992

[54] NONMETALLIC AUTOMOTIVE JACK

[75] Inventor: Charles W. Bailey, Bloomfield Hills, Mich.

[73] Assignee: Signet Industries, Fraser, Mich.

[21] Appl. No.: 703,183

[22] Filed: May 20, 1991

[51] Int. Cl.[5] ..... B66F 3/22

[52] U.S. Cl. ..... 254/122; 254/126; 254/DIG. 1

[58] Field of Search ..... 254/126, 122, 124, DIG. 1

[56] References Cited

U.S. PATENT DOCUMENTS 3,741,524 6/1973 Morgan et al. ..... 254/122
4,218,043 8/1980 Le Vert ..... 254/DIG. 1
4,474,387 10/1984 Maranell et al. ..... 254/DIG. 1

*Primary Examiner*—Robert C. Watson
*Attorney, Agent, or Firm*—Dykema Gossett

[57] ABSTRACT

A nonmetallic automotive jack includes a scissors assembly which is mounted on a base. The base includes a floor which flairs outwardly in a forward portion and outwardly in a rearward floor portion. The forward floor portion is longer than rearward floor portion. Inner side flanges are disposed upwardly from the base floor between the forward floor portion and the rearward floor portion. Perpendicular buttresses reinforce the inner flanges. The base has a multiplicity of tines that provide gripping traction for the base. The jack may be made of all plastic components or some combination of plastic and metal parts.

16 Claims, 2 Drawing Sheets

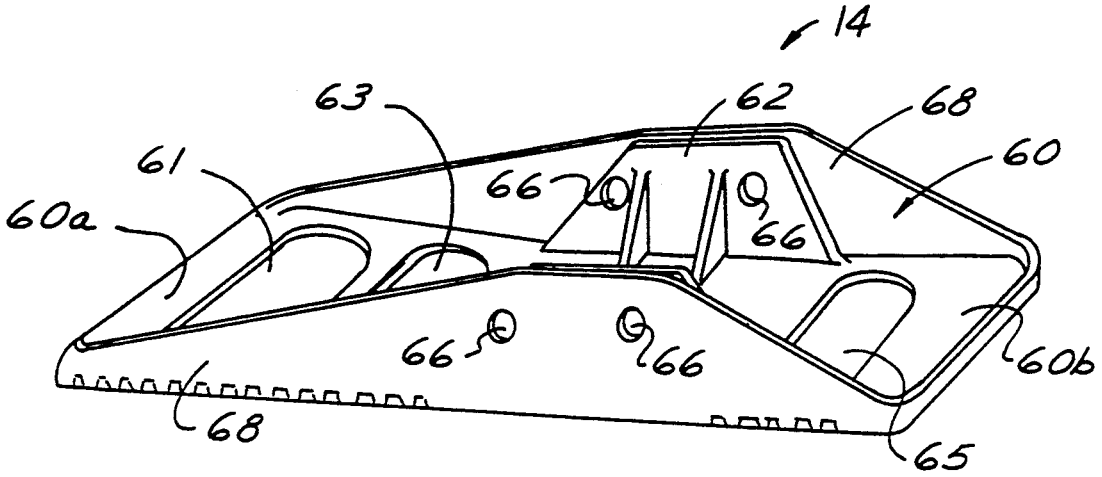
FIG.3
FIG.4
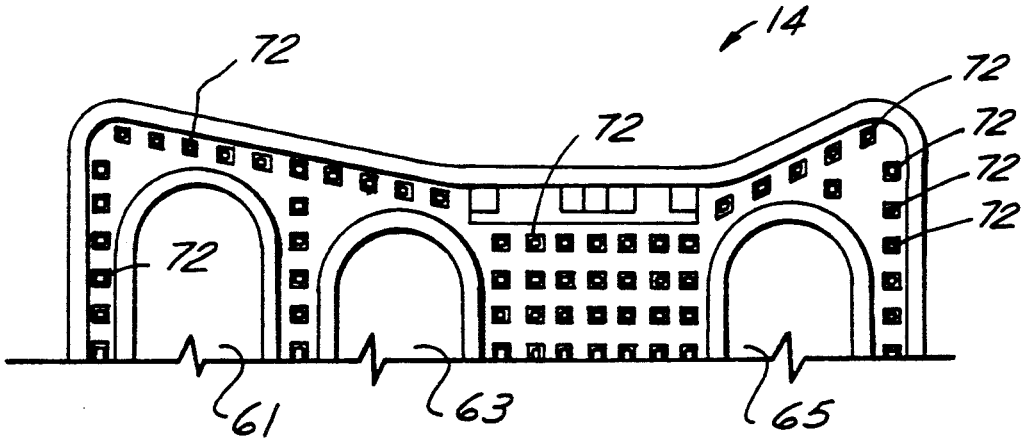

NONMETALLIC AUTOMOTIVE JACK

BACKGROUND OF THE INVENTION

1. Field of the Invention

The present invention relates to light weight jacks for raising heavy objects, and more particularly, to jacks having plastic components to lessen the weight of such jacks as compared to conventional metallic jacks.

2. Description of the Prior Art

There are many types of jack mechanisms for raising heaving objects, particularly automobiles. Such jacks are a necessary part of the original equipment of automobiles, conveniently and compactly transported in the automobile to be on hand in case of an emergency requiring a jack, for example, a flat tire.

Such jacks are usually constructed of metal, which has the advantage of strength and durability. But there are also disadvantages to this material for the construction of jacks. Metal is a relatively expensive material because of the fabrication and process expense. Thus, the material greatly influences the cost of the jack. Metals, particularly relatively inexpensive metals, corrode. Corrosion effects the mechanics of the jack, such as interfering with relative movements between working parts. Metal parts coming into contact with one another clank and rattle. Consequently, a metal jack in the trunk of a car makes loud noises and sends vibration throughout its carrier. Metal also makes jacks heavy, adding to the overall weight of the automobiles in which they are transported. Additions to the weight of an automobile reduce its mileage efficiency. Moreover, heavy metal objects such as jacks stored in the trunk of an automobile become missiles under the right, or if you will, wrong conditions, such as sudden arrest of the automobile in a collision. The severity of the missile phenomenon is also related to the weight of the jack as a function of the momentum of the jack in a fast moving vehicle.

While it is known that weight reductions may be achieved by using low weight material, no successful jack device for heavy objects has been constructed of low weight plastic material because no structure has been developed to be made of plastic while being strong enough to lift a heavy object such as a motor vehicle. One drawback in adapting existing jack structures to plastic construction is that the standard metal jacks are better able to withstand the bending and torsion forces to which the jacks are exposed. Another drawback is that the base of a plastic jack lacks the weight of a metal jack so that it lacks the weight component necessary for frictional interface with the ground to keep the base from "kicking out." This particularly happens in the initial working of the jack to seat itself with a leverage that transfers the weight of the automobile to the base in a particular alignment.

OBJECTS OF THE INVENTION

The above disadvantages of metal jacks and the drawbacks of plastic jacks are obviated by the present invention, one object of which is to provide a jack mechanism for raising heavy objects, particularly automobiles, where the jack is relatively inexpensive because of the material out of which it is fabricated.

It is also an object of the present invention to provide an automobile jack that will not corrode and thereby affect the mechanics of the jack.

It is yet another object of the present invention to provide a jack with parts that may come into contact with one another and with the automobile body while in its trunk, without the jack and its parts clanking and rattling.

Yet still another object of the present invention is to provide a nonmetallic jack that is relatively light weight so as to add little to the weight of an automobile and reduce it mileage efficiency.

Still yet another object of the present is to provide a relatively light weight nonmetallic jack that, when stored in the trunk of an automobile, will not become a missile when there is a sudden arrest of the automobile in a collision.

SUMMARY OF THE INVENTION

In accomplishing the above objects, the present invention is a nonmetallic automotive jack that includes a scissors assembly mounted on a base. An actuator unit may be actuated by a crank handle. The crank handle may be grasped and manipulated by the user to turn a jack screw to elevate the jack and an automobile mounted thereon.

The jack operating screw is positioned generally along the centerline of the base of the nonmetallic automotive jack and the centerline of a set of links that make up the scissors mechanism of the jack. Lower rearward links are connected to an upper rearward link. A plain, not threaded trunnion spans between the links. The jack operating screw extends in a cross direction, that is, perpendicular to the direction in which the plain trunnion spans, through an opening in the plain trunnion. Thus situated, the jack operating screw is free to pivot about its axis.

Each of the lower rearward links and the upper rearward link have lower and upper rearward fork ends. The fork ends fit snugly around the plain trunnion and are trapped between flanges. The upper rearward link is a unitary structure having a flange, a top surface, and a cross-spanning flange. Preferably, the top surface has a non-planar (with depressions) topography to give it added structural rigidity.

The end of the upper link that is reinforced by a cross-spanning flange provides a saddle on which a part of the automobile is seated when the nonmetallic automotive jack raises the automobile in the manner of its use. The saddle has a portion which cups a structural part of the underpanel of an automobile. The saddle is adapted to move or rotate about the structural member supported by the nonmetallic automotive jack as the jack is operated, so that the leverage of the jack is maintained.

The forward lower links are connected to upper forward links by means of a threaded trunnion. The threaded trunnion also has an opening extending through it, perpendicular to its axis, through which the jack operating screw extends. The jack operating screw is threadably engaged with the threaded trunnion. With respect to the threaded trunnion, the jack operating screw is free to pivot about its axis screwing along the bias of the threaded trunnion.

The upper forward link is also a unitary structure having flanged, and a top surface. As with the top surface of the upper link, the top surface has a non-planar (with depressions) topography to give it added structural rigidity.

Each of lower forward links and upper forward link have lower and upper forward fork ends. The fork ends fit snugly around the threaded trunnion.

Both the lower forward links and the lower rearward links have gear ends. These ends mesh to cause the links to coordinate the rotation of links. Where the links are made of a nonmetallic, plastic material, the gear ends are preferably with rounded gear teeth, which transfer the stress better for the plastic material.

The upper forward link is pinned to the upper rearward link by the top rivet. Accordingly, the scissors assembly comprises the structure resulting from the pinned connections. When the actuator unit is actuated by a crank handle or "tire iron", the tire iron or crank handle may be grasped and manipulated by the user to rotate the jack operating screw, causing the threaded trunnion to travel toward or away from plain trunnion. Rotating the jack operating screw in one direction brings about a vertical disposition to elevate saddle when base is on the ground.

Of particular importance to one embodiment of the nonmetallic automotive jack is the shape of the upper rearward link. According to the preferred embodiment, the upper rearward link flanges curve inwardly. This structure is adapted to receive the bending moments experienced by the upper rearward link and transfer the load to the base without the plastic structure failing.

Also of particular importance to an embodiment of nonmetallic automotive jack is the structure of base. The base comprises a floor which flares outwardly in a forward floor portion and which flares outwardly in a rearward floor portion. The forward floor portion is longer than rearward floor portion. This is because as the upper rearward link pivots upward, its load is transferred to the forward portion of base.

Inner side flanges are disposed upwardly from the base floor between the forward floor portion and the rearward floor portion. Perpendicular buttresses are disposed perpendicular to the inner flanges to add column strength to and to stabilize the flanges. Each flange has a pair of rivet holes.

Adjacent each inner side flange is an outer side flange. Each outer side flange spans along the sides of the forward floor portion and the rearward floor portion. Each outer side flange also has rivet holes, which aligng with the rivet holes of the inner side flanges.

Base rivets span through the rivet holes and through holes in the gear ends of the lower links. Accordingly, the lower links are in pivotal connection with the base, each link being connected between the inner and outer flanges.

To provide adequate frictional interface between a ground surface and the base, given the light weight of base and to maintain proper leverage provided by the formed parts of nonmetallic automotive jack, the base has a multiplicity of tines. Tines provide gripping traction for the base. The tines are generally regularly spaced on the underside of the base.

The present invention may be made of all plastic components or some combination of plastic and metal parts.

BRIEF DESCRIPTION OF THE DRAWINGS

FIG. 3 is a perspective view of the jack base in accordance with the invention.

FIG. 4 is a partial plan view of the undersurface of the jack base in accordance with the invention.

DETAILED DESCRIPTION OF THE PREFERRED EMBODIMENT

Figure 1:
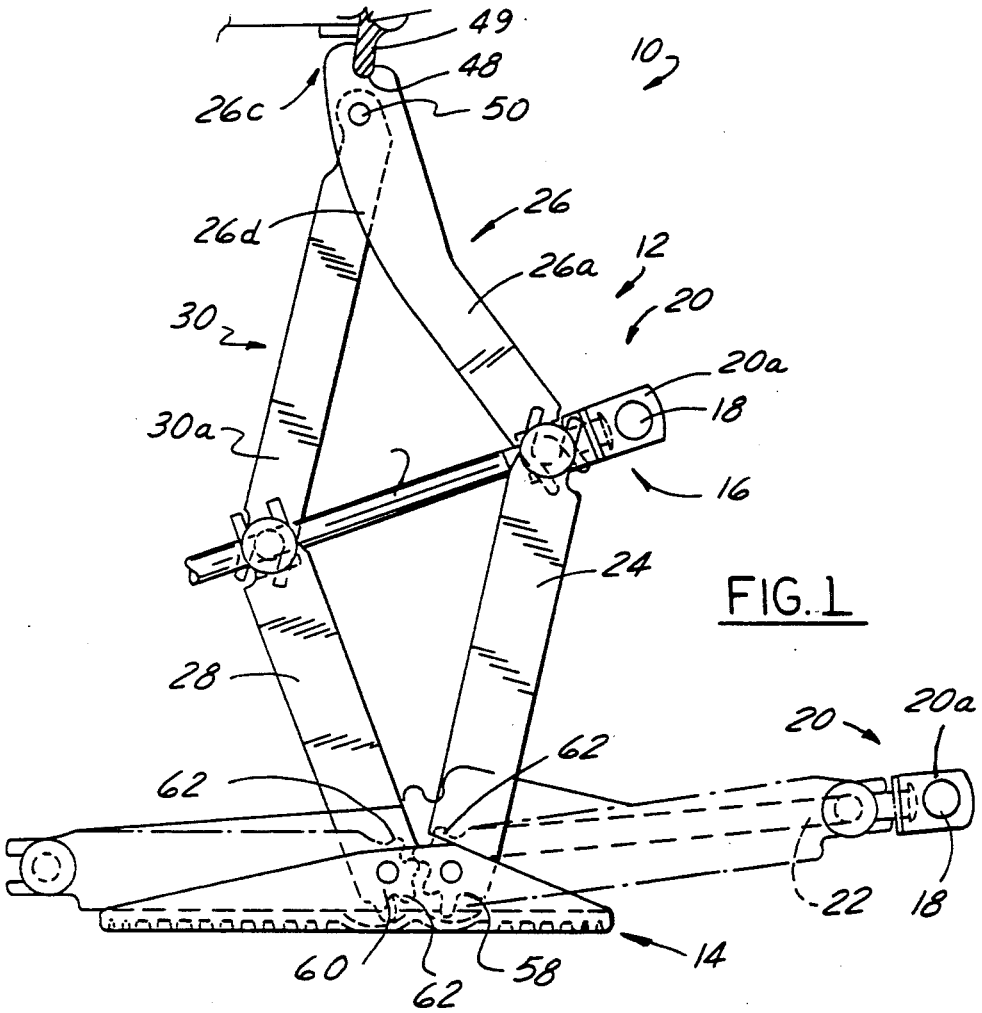
FIG. 1 is a side view of the nonmetallic automotive jack comprising the invention.

Referring first to FIG. 1, the invention comprises a nonmetallic automotive jack 10 which includes a scissors assembly 12 that is mounted on a base 14. An actuator unit 16 may be actuated by a crank handle (not shown) of the kind usually provided as standard equipment and designated a "tire iron." One end of the tire iron or crank handle may be inserted in eyelets 18, which are through each flange **20*a* and 20*b* of a screw head 20 fixedly connected to a jack operating screw 22. The tire iron or crank handle may be grasped and manipulated by the user to turn the jack operating screw 22** in a manner to be explained later.

Figure 2:
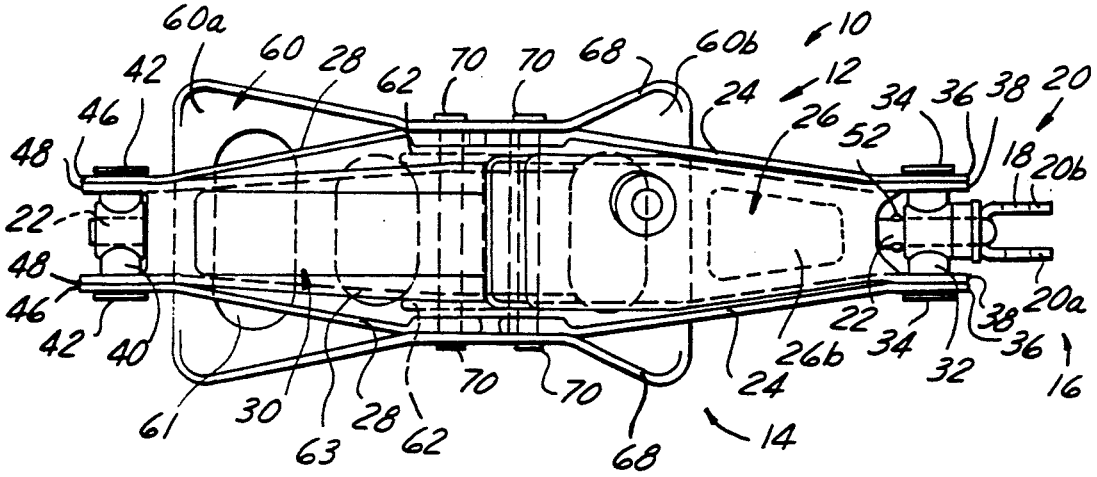
FIG. 2 is a plan view of the jack comprising the invention.

As can be seen in FIG. 2, jack operating screw 22 is positioned generally along the centerline of nonmetallic automotive jack 10 and links 24, 26, 28 and 30. Referring once again to FIG. 1, lower rearward links 24 are connected to upper rearward link 26.

As can be seen more clearly in FIG. 2, the means of connecting lower rearward links 24 to upper rearward link 26 is a plain; not threaded trunnion 32. Plain trunnion 32 has an opening extending through it, perpendicular to its axis, for a purpose to be explained shortly. Plain trunnion 32 spans between links 24 and 26. At each end of plain trunnion 32 is a flange 34 having a diameter greater than the spanning portion of plain trunnion 32.

Jack operating screw 22 extends in a cross direction to the extension of plain trunnion 32, that is, perpendicular to the direction in which plain trunnion 32 spans. Jack operating screw 22 extends through the opening in plain trunnion 32, to screw head 20. Thus situated, jack operating screw 22 has limited movement along the axis of the opening in plain trunnion 32 through which jack operating screw 22 extends, as screw head 20 limits its movement in one direction and stops 52 limit its movement in the opposite direction. Nevertheless, jack operating screw 22 is free to pivot about its axis.

Still referring to FIG. 2, each of lower rearward links 24 and upper rearward link 26 have lower and upper rearward fork ends 36 and 38, respectively. Fork ends 36 and 38 fit snugly around plain trunnion 32 and are trapped between flanges 34. Upper rearward link 26 is shown to be a unitary structure having a flange **26*a* shown in FIG. 1 and a top surface 26*b* and a cross-spanning flange 26*c*, both indicated in FIG. 2. Preferably, top surface 26*b*** has a non-planar (with depressions) topography to give it added structural rigidity.

The end reinforced by cross-spanning flange **26*c* is contoured into a saddle 48 on which a part of the automobile may be seated when the nonmetallic automotive jack 10 raises the automobile in the manner that will be explained later. Saddle 48 cups a structural part of the underpanel of an automobile. The saddle 48 is adapted to move or rotate about the structural member 49 of the automobile that is supported by the nonmetallic automotive jack 10, as the jack 10 is operated, so that the leverage of the jack 10** is maintained.

Again referring to FIG. 1, lower forward links 28 are connected to upper forward links 30. As can also be seen more clearly in FIG. 2, the means of connection is threaded trunnion 40. Threaded trunnion 40 also has an opening extending through it, perpendicular to its axis, through which opening jack operating screw 22 extends. Each end of threaded trunnion 40 also has a flange 42 having a diameter greater than the spanning portion of threaded trunnion 40. Jack operating screw 10 is threadably engaged with threaded trunnion 40. With respect to threaded trunnion 40, jack operating screw 22 is free to pivot about its axis screwing along the base of threaded trunnion 40.

Upper forward link 30 is shown to be a unitary structure having a flange 30*a* shown in FIG. 1 and a top surface 30*b* shown in FIG. 2. As with the top surface 26*b* of upper link 26, top surface 30*b* has a non-planar (with depressions) topography to give it added structural rigidity.

Still referring to FIG. 2, each of lower forward links 28 and upper forward link 30 have lower and upper forward fork ends 44 and 46, respectively. Fork ends 44 and 46 fit snugly around rear threaded trunnion 40 and are trapped between flanges 42.

As can be seen in FIG. 1, both lower forward links 28 and lower rearward links 24 have gear ends 58 and 60, respectively, remove from their fork ends 36 and 44. These ends mesh to cause the links to coordinate the rotation of links 24, 26, 28 and 30 as is known by those skilled in the art. Where the links are made of a nonmetallic, plastic material, gear ends 58 and 60 are preferably with rounded gear teeth 62, which transfer the stress better for the plastic material.

Upper forward link 30 is pinned to upper rearward link 26 by top rivet 50. Accordingly, scissors assembly 12 comprises the structure resulting from the pinned connections, by top rivet 50 and plain and threaded trunnions 32 and 40, of links 24, 26, 28 and 30. When the actuator unit 16 is actuated by a crank handle or "tire iron" (not shown), with one end of the tire iron or crank handle inserted in the actuator eyelet 18, the tire iron or crank handle may be grasped and manipulated by the user to rotate the jack operating screw 22, causing threaded trunnion 40 to travel toward or away from plain trunnion 32 in a manner known by those skilled in the art. Rotating jack operating screw 22 in one direction pulls in the conjuncture of links 24 and 26 the conjuncture of links 28 and 30 toward one another, pulling links 24, 26, 28 and 30 toward a vertical disposition to elevate saddle 48 when base 14 is on the ground.

Of particular importance to one embodiment of nonmetallic automotive jack 10 is the shape of the upper rearward link 26. According to the preferred embodiment, the upper rearward link flanges 26*a* curve inwardly at edge 26*d*. This structure is adapted to receive the bending moments experienced by the upper rearward link and transfer the load to the base 14 without the plastic structure failing.

Also of particular importance to an embodiment of nonmetallic automotive jack 10 is the structure of base 14. According to the preferred embodiment shown particularly in FIG. 3, the base 14 comprises a floor 60 which flairs outwardly in a forward floor portion 60*a* and which flairs outwardly in a rearward floor portion 60*b*. Forward floor portion 60*a* is longer than rearward floor portion 60*b*. This is because as upper rearward link 26 pivots upward, its load is transferred to the forward portion of base 14. Floor 60 has openings 61, 63 and 65 for weight reduction and material savings and for gripping base 14 to carry nonmetallic automotive jack 10.

Inner side flanges 62 are disposed upwardly from the jack floor 60 between the forward floor portion 60*a* and the rearward floor portion 60*b*. Perpendicular buttresses 64 are disposed perpendicular to flanges 62 to add column strength to flanges 62. Each flange 62 has a pair of rivet holes 66. Adjacent each inner side flange 62 is an outer side flange 68. Each outer side flange 68 spans along the sides of the forward floor portion 60*a* and the rearward floor portion 60*b*. Floor 60 has two depressions between each pair of flanges 62 and 68 to accommodate rotating gear ends 58 and 60 shown in FIG. 1. Each outer side flange 68 also has rivet holes 66 aligning with the rivet holes 66 of inner side flanges 62.

Base rivets 70, shown in FIG. 2, span through rivet holes 66 and through holes in the gear ends of links 24 and 28. Accordingly, lower links 24 and 28 are in pivotal connection with base 14, each link between inner and outer flanges 62 and 68.

To provide adequate frictional interface between a ground surface and base 14, given the light weight of base 14 and to maintain proper leverage provided by the formed parts of nonmetallic automotive jack 10, base 14 has a multiplicity of tines 72, as shown in FIG. 4. Tines 72 provide gripping traction for base 14. Tines 10 are generally regularly spaced on the underside of base 14.

The present invention may be made of all plastic components. Such components are preferably made of 50% long glass fiber filled nylon, such as commercialized under the designation ICI or "VERTON". Alternatively, some components, such as knuckles and screws may be of metal. Finally, all but the base may be made of metal components. Any of the variations will keep the weight of the jack in the range of 3 to 7 pounds.

Thus, the present invention provides a lightweight, portable nonmetallic automotive jack 10 constituted preferably of glass filled plastic material. Such a jack is not subject to corrosion, rattles and other metallic noises, and excessive weight. From the above description of the present invention it will be evident that many modifications thereto will become apparent to those skilled in the art to which it pertains without departing from the scope and spirit of the appended claims.

I claim:

1. A nonmetallic automotive jack comprising:

a base having a floor, said floor having an upper surface and a under surface, said floor including a forward portion, a rearward portion, and an intermediate portion situated between said forward and rearward portions, said base having two pairs of generally parallel side flanges extending, with respect to said upper surface, upwardly from said floor, said intermediate portion of said floor being situated between said pairs of side flanges, each pair of side flanges comprising an nonmetallic inner side flange and an outer side flange, said inner side flanges being situated between said outer side flanges;

a pair of buttresses for providing column strength to the nonmetallic inner side flanges, each pair of said buttress extending perpendicularly from each one of said inner side flanges toward the other of said inner side flanges, said buttresses contacting the upper surface of said intermediate portion of said floor between said inner side flanges;

a scissors mechanism rotatably attached to said base by attachment means between each inner and outer side flange of said pair of side flanges, said scissors mechanism having seating means for mounting a part of an automobile thereon, so that said automobile may be lifted by said scissors mechanism; and actuator means for actuating said scissors mechanism to elevate said seating means with said automobile mounted thereon.

2. The nonmetallic automotive jack of claim 1, wherein at least all parts of said base is constituted of a glass filled, plastic material.

3. The nonmetallic automotive jack of claim 2, wherein said base has a multiplicity of tines, said tines depending from the undersurface of said floor to provide gripping traction for said base.

4. The nonmetallic automotive jack of claim 3, wherein said forward floor portion flares outwardly from said intermediate floor portion and said rearward floor portion flares outwardly from said intermediate floor portion.

5. The nonmetallic automotive jack of claim 4, wherein said forward floor portion is longer than said rearward floor portion.

6. The nonmetallic automotive jack of claim 2, wherein said scissors mechanism comprises a lower rearward link, an upper rearward link, a lower forward link and an upper forward link, said lower rearward link having a first rotatable connection with said upper rearward link, said lower forward link having a second rotatable connection with said upper forward link, and said upper rearward link having a third rotatable connection with said upper forward link, each of said first and second rotatable connections including a trunnion, each trunnion has an opening extending through it perpendicular to its axis, one trunnion having a plain opening and the other trunnion having a threaded opening, and wherein said actuator means includes a jack operating screw extending through said openings, said jack including means limiting axial movement of said jack operating screw with respect to said trunnion having a plain opening and said jack being in threadable engagement with said trunnion having a threaded opening, said jack screw including means to interface with a crank handle for turning said jack screw, whereby, when said jack screw is turned in one direction, said threaded trunnion travels toward said plain trunnion causing said links to move generally into a vertical disposition and when said jack screw is turned in another direction, said threaded trunnion travels away from said plain trunnion causing said links to move generally into a horizontal disposition.

7. The nonmetallic automotive jack of claim 6, wherein the said upper forward link extends beyond said third rotatable connection to a free end contoured into a saddle on which a part of the automobile may be seated so that when said links move generally into a vertical disposition, said automobile will be elevated, and when said links move generally into a horizontal direction, said automobile will be lowered.

8. The nonmetallic automotive jack of claim 7, wherein said saddle is adapted to cup a structural part of the underpanel of said automobile and to move or rotate about the structural member of said automobile.

9. A nonmetallic base for an automotive jack comprising:

a floor, two outer flanges, and two inner flanges, said floor having an upper surface and a under surface, said floor including a forward portion, a rearward portion, and an intermediate portion situated between said forward and rearward portions, said base being constituted of a glass filled, plastic material, said base having a multiplicity of tines, said tines depending from the undersurface of said floor to provide gripping traction for said base, said forward floor portion and said rearward floor portion flaring outwardly from said intermediate floor portion, said forward floor portion being longer than said rearward floor portion.

10. A nonmetallic base for an automotive jack comprising:

a floor having an upper surface and a under surface, said floor including a forward portion, a rearward portion, and an intermediate portion situation between said forward and rearward portions;

two pairs of nonmetallic, generally parallel side flanges extending, with respect to said upper surface, upwardly from said floor, said intermediate portion of said floor being situated between said pairs of side flanges, each pair of side flanges comprising an inner side flange and an outer side flange, said inner side flanges being situated between said outer side flanges; and two pairs of buttresses for providing column strength to the nonmetallic inner side flanges, each pair of said buttresses extending perpendicularly from each one of said inner side flanges toward the other of said inner side flanges, said buttresses contacting the upper surface of said intermediate portion of said floor between said inner side flanges.

11. The nonmetallic base for an automotive jack of claim 10, wherein said forward floor portion flares outwardly from said intermediate floor portion and said rearward floor portion flares outwardly from said intermediate floor portion.

12. The nonmetallic base for an automotive jack of claim 11, wherein said base has a multiplicity of tines, said tines depending from the undersurface of said floor to provide gripping traction for said base.

13. The nonmetallic base for an automotive jack of claim 11, wherein said forward floor portion is longer than said rearward floor portion.

14. The nonmetallic automotive jack of claim 1, wherein the buttresses are situated between said attachment means.

15. The nonmetallic base for an automotive jack of claim 10, wherein the buttresses are situated between said attachment means.

16. The nonmetallic base for an automotive jack of claim 10, wherein all parts of said base are constituted of a glass filled, plastic material.

* * * * *